US011639576B2

(12) United States Patent
Deshmukh et al.

(10) Patent No.: US 11,639,576 B2
(45) Date of Patent: May 2, 2023

(54) DISPENSER BOX FOR WASHER AND DRYER COMBINATION APPLIANCE

(71) Applicant: Whirlpool Corporation, Benton Harbor, MI (US)

(72) Inventors: Rajwardhan Deshmukh, Maharashtra (IN); Jason R. Spears, St. Joseph, MI (US); Kurt L. Masciovecchio, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/339,086

(22) Filed: Jun. 4, 2021

(65) Prior Publication Data

US 2022/0389640 A1 Dec. 8, 2022

(51) Int. Cl.
*D06F 39/02* (2006.01)
*D06F 23/02* (2006.01)

(52) U.S. Cl.
CPC ..... *D06F 39/028* (2013.01); *D06F 23/02* (2013.01)

(58) Field of Classification Search
None
See application file for complete search history.

(56) References Cited

U.S. PATENT DOCUMENTS

| | | | | |
|---|---|---|---|---|
| 7,895,864 | B2 | 3/2011 | Hill | |
| 2003/0145633 | A1* | 8/2003 | Merkle | D06F 39/02 68/17 R |
| 2007/0056330 | A1* | 3/2007 | Song | D06F 39/02 68/17 R |
| 2008/0078210 | A1* | 4/2008 | Kim | D06F 35/00 68/4 |

(Continued)

FOREIGN PATENT DOCUMENTS

| | | | |
|---|---|---|---|
| EP | 2519676 | B1 | 11/2013 |
| EP | 2519677 | B1 | 4/2015 |
| KR | 100429644 | B1 | 5/2004 |

(Continued)

OTHER PUBLICATIONS

Washing Machine Detergent Dispenser Top Section / eSpares; By: eSpares The online parts store, Dated Oct. 29, 2020; 4 pages; https://www.espares.ie/product/es1346072/washing-machine-detergent-dispenser-top-section.

(Continued)

*Primary Examiner* — Cristi J Tate-Sims
(74) *Attorney, Agent, or Firm* — Harness, Dickey & Pierce, PLC

(57) ABSTRACT

A dispenser box assembly for a laundry appliance that includes a dispenser housing and a lid. The dispenser housing includes one or more housing walls that define a main chamber. The lid is attached to the housing walls and includes an in-lid reservoir. The in-lid reservoir includes an inlet section that is arranged in fluid communication with (Continued)

water inlet ports in the dispenser housing and a diffuser section with an outlet that is arranged in fluid communication with the main chamber. An air port that is open to the atmosphere is arranged in fluid communication with the main chamber such that the main chamber is open to atmospheric pressure and produces a water pressure drop between the water inlet ports and a water outlet port at the bottom of the main chamber.

19 Claims, 8 Drawing Sheets

(56) References Cited

U.S. PATENT DOCUMENTS

2009/0053119 A1 2/2009 Richman et al.

FOREIGN PATENT DOCUMENTS

| | | | |
|---|---|---|---|
| KR | 20090081585 | A | 7/2009 |
| WO | 9422353 | A1 | 10/1994 |
| WO | 2020147770 | A1 | 7/2020 |

OTHER PUBLICATIONS

Washing Machine Soap Dispenser Housing Lid & Water Distributer / eSpares; By: eSpares The online parts store, Dated Oct. 29, 2020; 4 pages; https://www.espares.ie/product/es1708460/washing-machine-soap-dispensenser-housing-lid.

European Search Report for European Application No. 22177015.9-1016, dated Nov. 10, 2022 (73 Pages).

* cited by examiner

DISPENSER BOX FOR WASHER AND DRYER COMBINATION APPLIANCE

FIELD

The present disclosure relates generally to laundry appliances and more particularly to a dispenser box assembly for a washer and dryer combination appliance.

BACKGROUND

The statements in this section merely provide background information related to the present disclosure and may not constitute prior art.

Laundry appliances (i.e., laundry machines, washing machines, and dryers) are prolific in both residential and commercial settings. Traditionally, separate washer and dryer machines have been used in tandem to clean and dry laundry. However, there is a growing market for washer and dryer combination appliances where a single machine performs both the washing and drying functions, thereby eliminating the need for two separate machines. There are a number of different names used to describe washer and dryer combination appliances, including without limitation, "washer/dryer combos" and "all-in-one washer dryers." While these units save space compared to separate washer and dryer machines, combining the washing and drying functions into a single appliance presents a number of engineering challenges.

Many washer and dryer combination appliances have a front-load appliance configuration, where the washer and dryer combination appliance includes an appliance housing with a front appliance opening that is accessed by a front-mounted appliance door. A drum is positioned in and is rotatable with respect to the appliance housing. A motor housed within the appliance housing rotates the drum. The drum typically has a front end with a drum opening that provides access to a laundry compartment inside the drum and a rear end opposite the front end that is coupled to the motor. During wash cycles, laundry in the laundry compartment repeatedly tumbles into water in the lower part of the drum and is then lifted back out of the water as the drum rotates. During drying cycles, warm air is blown through perforations in the rear wall of the drum to permit air flow into the laundry compartment.

Front-load laundry appliances, including both washer and dryer combination appliances and traditional washing machines, also typically have a dispenser box in the upper left corner of the appliance housing with a drawer that can be pulled out from the front of the appliance. This drawer typically includes multiple compartments, windows, and/or trays for receiving a single dose of detergent, bleach, or fabric softener, which is mixed with water in the dispenser box during the wash cycle and then fed into the laundry compartment.

SUMMARY

This section provides a general summary of the disclosure, and is not a comprehensive disclosure of its full scope or all of its features.

In accordance with one aspect of the present disclosure, a dispenser box assembly for a laundry appliance is provided where the dispenser box assembly includes a dispenser housing and a lid. The dispenser housing includes a bottom wall and one or more housing walls that cooperate to define a main chamber of the dispenser box assembly. The housing walls extend up from the bottom wall to an upper rim of the dispenser housing. One or more water inlet ports are positioned adjacent to the upper rim of the dispenser housing and a water outlet port is positioned adjacent to the bottom wall of the dispenser housing. The water outlet port is arranged in fluid communication with the main chamber of the dispenser box assembly.

The lid of the dispenser box assembly is attached to the upper rim of the dispenser housing. The lid includes an in-lid reservoir. The in-lid reservoir includes an inlet section that is arranged in fluid communication with the water inlet port(s) and a diffuser section with an outlet that is arranged in fluid communication with the main chamber. The dispenser box assembly also includes an air port that is open to the atmosphere and arranged in fluid communication with the main chamber. As a result, the main chamber is open to atmospheric pressure and therefore creates/produces a water pressure drop between the water inlet port(s) and the water outlet port. Advantageously, the air port also operates as an overflow spillway if the water outlet port becomes fully or partially blocked. This provides an anti-siphon function in this failure mode that prevents the back flow of water from the dispenser box assembly to the water inlet valve(s) at the rear of the laundry appliance in the event of a water outlet port and/or wash unit inlet blockage.

It should be appreciated that, in accordance with this configuration, the dispenser box assembly does not have a drawer for receiving doses of detergent, bleach, or fabric softener. Instead, the dispenser box assembly functions as an open to atmosphere pressure relief structure through which water flows from one or more water inlet valves of the laundry appliance to the wash unit inlet. The in-lid reservoir of the dispenser box assembly operates to deflect and diffuse the high pressure spray of water that is discharged from the water inlet valve(s). After the inlet water from the water inlet valve(s) is dispensed into the inlet section of the in-lid reservoir via the water inlet port(s), the water travels through the diffuser section of the in-lid reservoir and falls into the main chamber of the dispenser box assembly as it exits through the outlet of the in-lid reservoir. The water in the main chamber then drains through the water outlet port under the influence of gravity. Because the main chamber is open to the atmosphere via the air port, the water pressure at the water outlet port of the dispenser box assembly is simply the head pressure caused by the height of the water in the main chamber and is therefore considerably less than the water pressure at the water inlet port(s).

In accordance with other aspects of the present disclosure, the lid of the dispenser box assembly described above may include an upper wall, a lower wall that is spaced below the upper wall, and one or more sidewalls that extend from the upper wall to the lower wall. In accordance with one aspect of the present disclosure, the outlet of the in-lid reservoir is a plurality of apertures in the lower wall of the lid. Water flowing through the diffuser section of the in-lid reservoir exits through these apertures in the lower wall of the lid and falls into the main chamber as a shower. In accordance with another aspect of the present disclosure, the diffuser section of the in-lid reservoir includes an upper step and a lower step that is deeper than the upper step. The lower step of the in-lid reservoir is separated from the upper step by a riser and the outlet of the in-lid reservoir is an opening in the riser between the upper and lower steps. As a result of this configuration, water flow through the in-lid reservoir reverses in the lower step, exits through the opening in the riser, and falls into the main chamber as a waterfall. Advantageously, both designs slow down the stream of inlet water and reduce the water pressure and splash in the main chamber of the dispenser box assembly to minimize foaming therein.

BRIEF DESCRIPTION OF THE DRAWINGS

Other advantages of the present disclosure will be readily appreciated, as the same becomes better understood by reference to the following detailed description when considered in connection with the accompanying drawings wherein.

DETAILED DESCRIPTION

Figure 1:
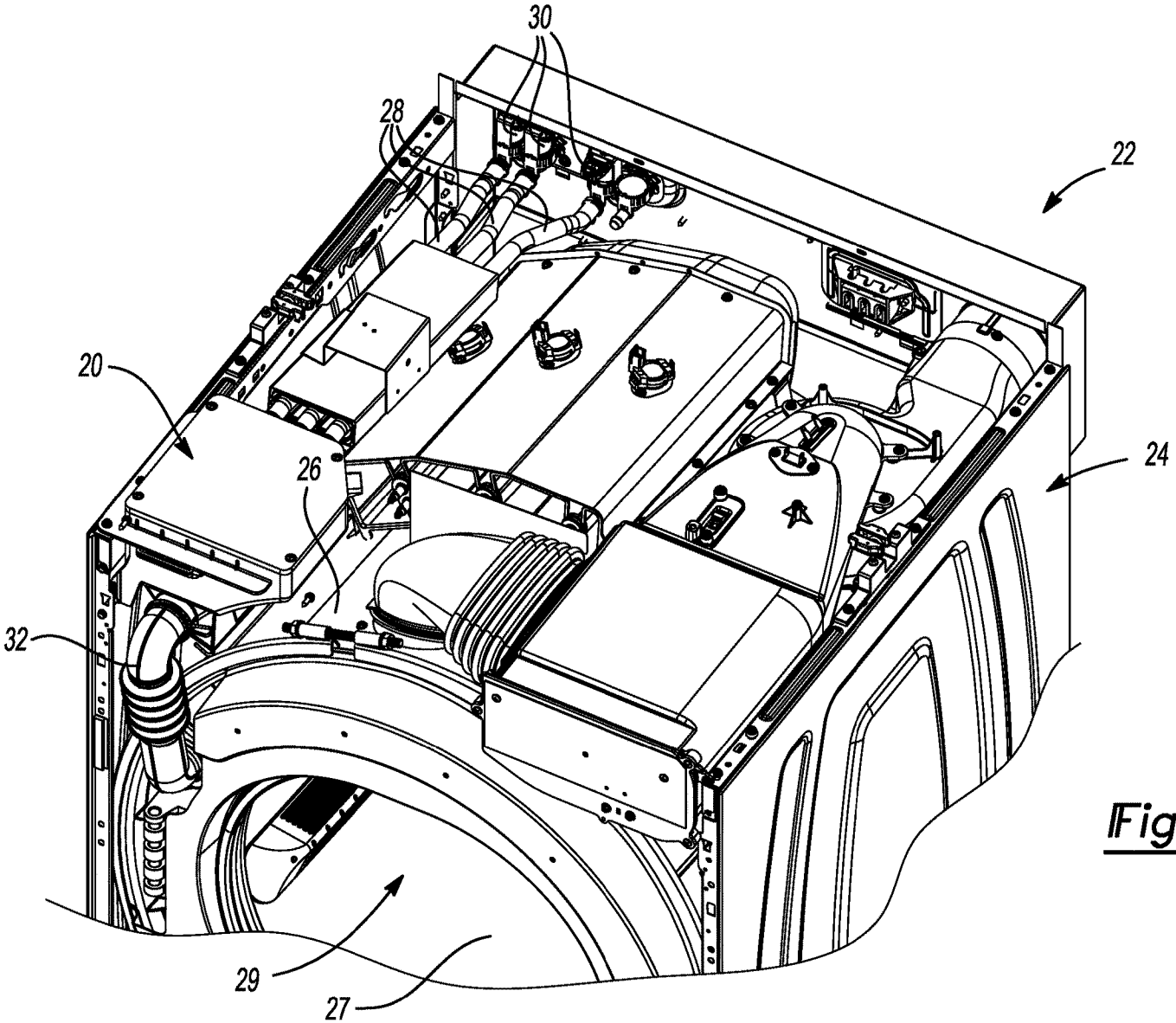
FIG. 1 is a front perspective view of part of an exemplary laundry appliance where the laundry appliance includes an appliance housing that has been partially removed in FIG. 1 to reveal several components of the laundry appliance, including an exemplary dispenser box assembly that has been constructed in accordance with the present disclosure.

Referring to the Figures, wherein like numerals indicate corresponding parts throughout the several views, a dispenser box assembly 20 for a laundry appliance 22 is illustrated.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

For purposes of description herein the terms "up," "down," "above," "below," "upper," "lower," "top," "bottom," "front," "rear," and derivatives thereof shall relate to the assembly as oriented in FIGS. 1-8. However, it is to be understood that the apparatus and assemblies described herein may assume various alternative orientations. In addition, the term "water" and "fluid" are used interchangeably herein to generally refer to wash water, which may be water or a water based mixture, solution, or suspension, such as water mixed with a detergent, bleach, and/or fabric softener for example and without limitation.

With reference to FIG. 1, the laundry appliance 22 has a front-load configuration and includes an appliance housing 24 that is rectangular in shape. While not shown in FIG. 1, it should be appreciated that when the laundry appliance 22 is fully assembled, a front appliance door is pivotally connected to the laundry appliance 22 to open and close a front opening in the appliance housing 24. A drum housing 26 having a cylindrical shape is mounted inside the appliance housing 24. The drum housing 26 does not rotate relative to the appliance housing 24, but does have limited degrees of freedom that allow the drum housing 26 to move/oscillate relative to the appliance housing 24 during tumbling. The drum housing 26 includes a front opening that leads to a cavity inside the drum housing 26.

A drum 27 is positioned in the drum housing cavity and is supported such that the drum 27 is rotatable with respect to the drum housing 26 about a longitudinal axis. The drum 27 also has a cylindrical shape and includes a drum opening that provides access to a laundry compartment 29 inside the drum 27. Thus, it should be appreciated that in use, laundry (e.g., clothes, towels, and bedding) is placed inside the laundry compartment 29 where it is first cleaned during a wash cycle and then dried during a drying cycle. A drive shaft (not shown), fixedly coupled to the drum 27, is supported by a bearing pack (not shown) such that the drive shaft and the drum 27 rotate together as a single unit within the appliance housing 24. A motor (not shown) is positioned in the appliance housing 24 and is coupled to the drive shaft. The motor drives rotation of the drive shaft and the drum 27 relative to the drum housing 26 and the appliance housing 24 during operation of the laundry appliance 22, such as during washing and tumbling.

The dispenser box assembly 20 of the laundry appliance 22 is fixedly mounted inside the appliance housing 24 at a position in the upper left corner, towards the front of the laundry appliance 22. As will be explained in greater detail below, the dispenser box assembly 20 is connected to three water inlet lines 28 that are connected in fluid communication with three water inlet valves 30 mounted at the rear of the laundry appliance 22. The dispenser box assembly 20 is also connected to a wash unit inlet pipe 32, which extends through a front wall of the drum housing 26 and terminates at a wash unit inlet.

Figure 2:
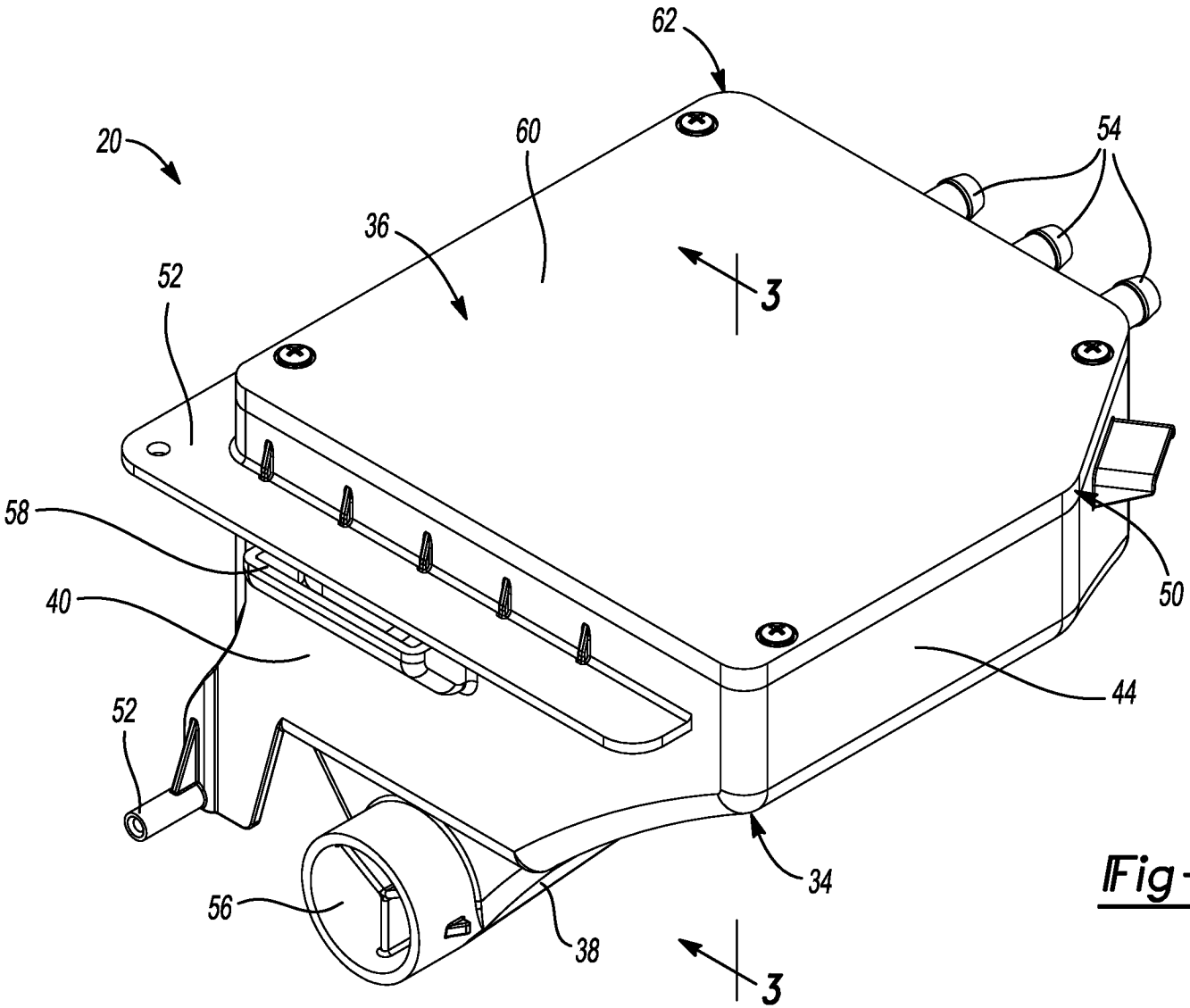
FIG. 2 is a front perspective view of the exemplary dispenser box assembly shown in FIG. 1.
Figure 3:
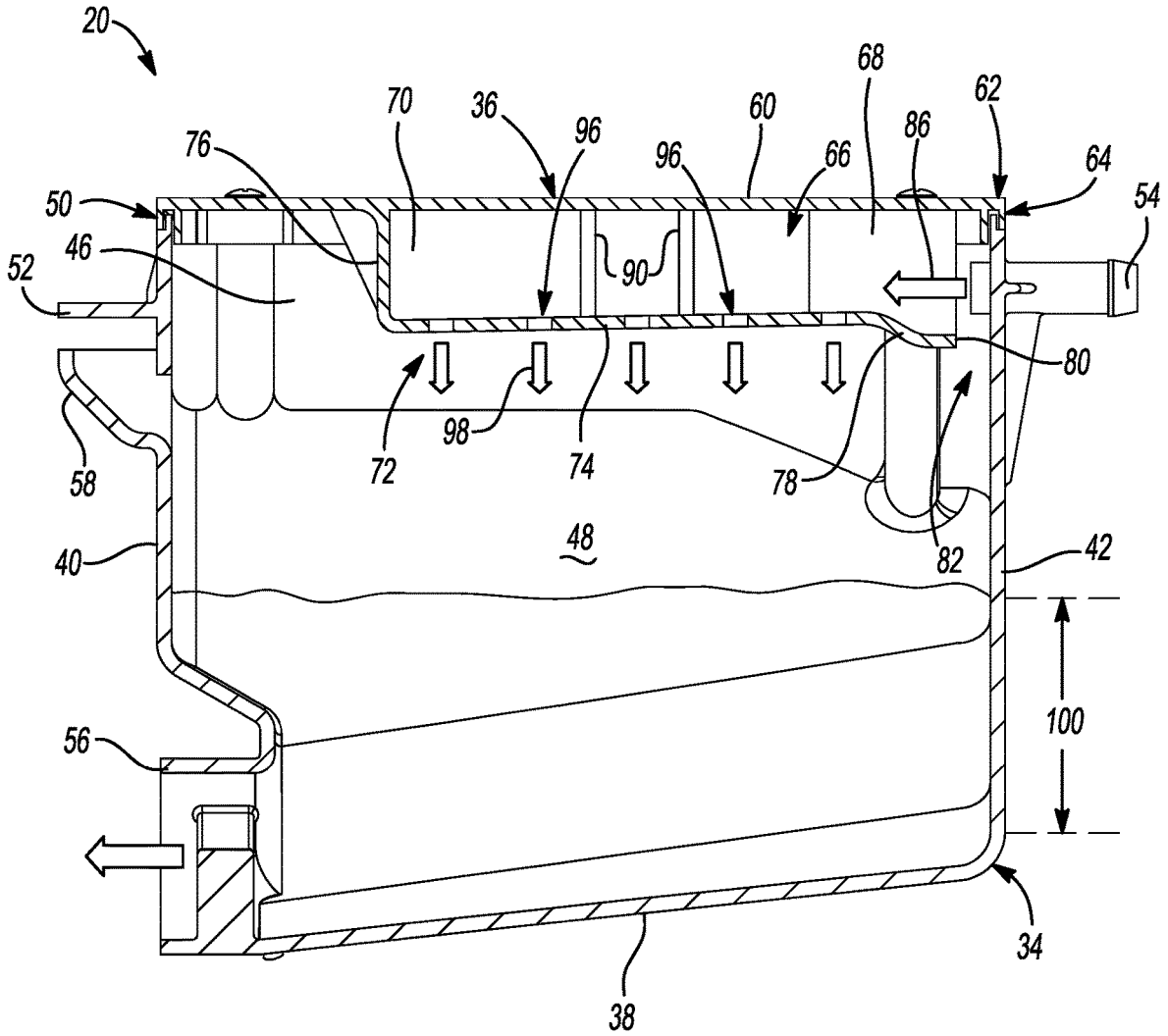
FIG. 3 is a side cross-sectional view of the exemplary dispenser box assembly shown in FIG. 2.

With reference to FIGS. 2 and 3, the dispenser box assembly 20 includes a dispenser housing 34 and a lid 36. The dispenser housing 34 has a bottom wall 38, a front housing wall 40, a rear housing wall 42, a right housing wall 44, and a left housing wall 46 that cooperate to define a main chamber 48 of the dispenser box assembly 20. The front housing wall 40 faces the front of the laundry appliance 22, the rear housing wall 42 faces the water inlet valves 30 at the rear of the laundry appliance 22, the bottom wall 38 and the right housing wall 44 generally face toward the drum housing 26, and the left housing wall 46 faces away from the drum housing 26. However, it should be appreciated that other arrangements are possible where the dispenser housing 34 has a different number of walls than those illustrated in the Figures.

The front, rear, right, and left housing walls 40, 42, 44, 46 extend up from the bottom wall 38 to an upper rim 50 of the dispenser housing 34 and may include a variety of different attachment features 52 used for fixedly mounting the dispenser box assembly 20 inside the appliance housing 24. Although the number and location may vary, in the illustrated embodiment, the dispenser housing 34 includes three water inlet ports 54 that are integral (e.g., co-molded) with the rear housing wall 42 at spaced apart positions adjacent to the upper rim 50 of the dispenser housing 34. The three water inlet ports 54 in the dispenser housing 34 are configured to be connected in fluid communication with the three water inlet valves 30 via the three water inlet lines 28 shown in FIG. 1. The dispenser housing 34 also includes a water outlet port 56 that is integral (e.g., co-molded) with the front housing wall 40 at a position adjacent to the bottom wall 38 of the dispenser housing 34. The water outlet port 56 of the dispenser housing 34 is arranged in fluid communication with the main chamber 48 and is configured to be connected in fluid communication with the wash unit inlet pipe 32 shown in FIG. 1. As a result, water in the main chamber 48 drains down through the water outlet port 56, travels through the wash unit inlet pipe 32, and into the drum housing 26 during a wash cycle.

The dispenser box assembly 20 also has an air port 58 that is open to the atmosphere and arranged in fluid communication with the main chamber 48 of the dispenser box assembly 20. While the air port 58 of the dispenser box assembly 20 could be placed in a number of different locations on the dispenser box assembly 20 and/or the lid 36, in the illustrated example, the air port 58 is located in and extends through the front housing wall 40 of the dispenser housing 34 at a location adjacent to the upper rim 50 of the dispenser housing 34. More specifically, the air port 58 in the illustrated example is configured as a scoop that protrudes from the front housing wall 40 and has an upwardly directed opening. This particular location and configuration of the air port 58 is advantageous should water in the main chamber 48 overflow and spill out through the air port 58, which doubles as an overflow spillway and anti-siphon feature. For example, if the water outlet port 56 in the dispenser housing 34 becomes fully or partially blocked, the air port 58 will act as an overflow spillway and direct water out through the front housing wall 40, where it is less likely to interfere with or damage the electrical components of the laundry appliance 22. Should this failure mode occur, the air port 58 also provides an important anti-siphon functionality that prevents the back flow of water from the dispenser box assembly 20 to the water inlet valves 30 at the rear of the laundry appliance 22. This greatly reduces the risk of back-feeding water into the water supply lines of a home or building.

The lid 36 of the dispenser box assembly 20 includes an upper wall 60 with a perimeter 62 that mates with and is fixedly attached to the upper rim 50 of the dispenser housing 34. Optionally, the lid 36 may include a double lip interface 64 along the perimeter 62 of the upper wall 60 with an elastomeric seal or gasket to create a fluid-tight seal between the upper wall 60 of the lid 36 and the upper rim 50 of the dispenser housing 34. Unlike conventional dispenser boxes that include a drawer with compartments for receiving single doses of detergent, bleach, and/or fabric softener, the dispenser box assembly 20 described herein is configured to be fixedly secured within the laundry appliance 22 and has a drawer-less configuration. No part of the dispenser box assembly 20, including no part of the dispenser housing 34 or lid 36, is configured to move out from inside the appliance housing 24. Stated differently, the lid 36 and the dispenser housing 34 described herein do not include user accessible compartments for receiving a dose of detergent, bleach, or fabric softener and are inaccessible from outside the laundry appliance 22. Instead, the dispenser box assembly 20 functions as an open to atmosphere, pressure relief structure through which water flows from the water inlet valves 30 of the laundry appliance 22 to the wash unit inlet pipe 32.

Figure 4:
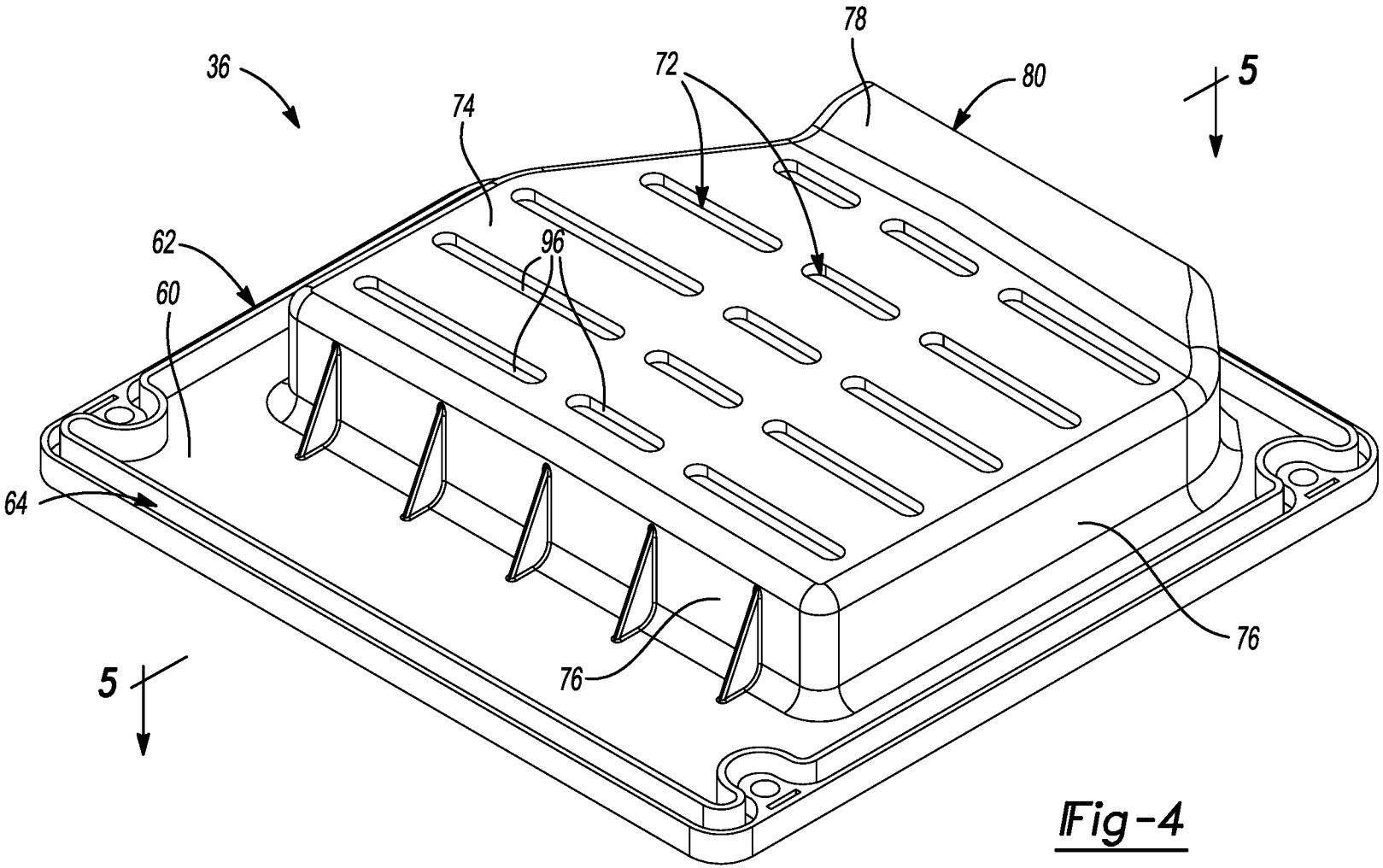
FIG. 4 is a bottom perspective view of an exemplary lid of the dispenser box assembly shown in FIG. 3.
Figure 5:
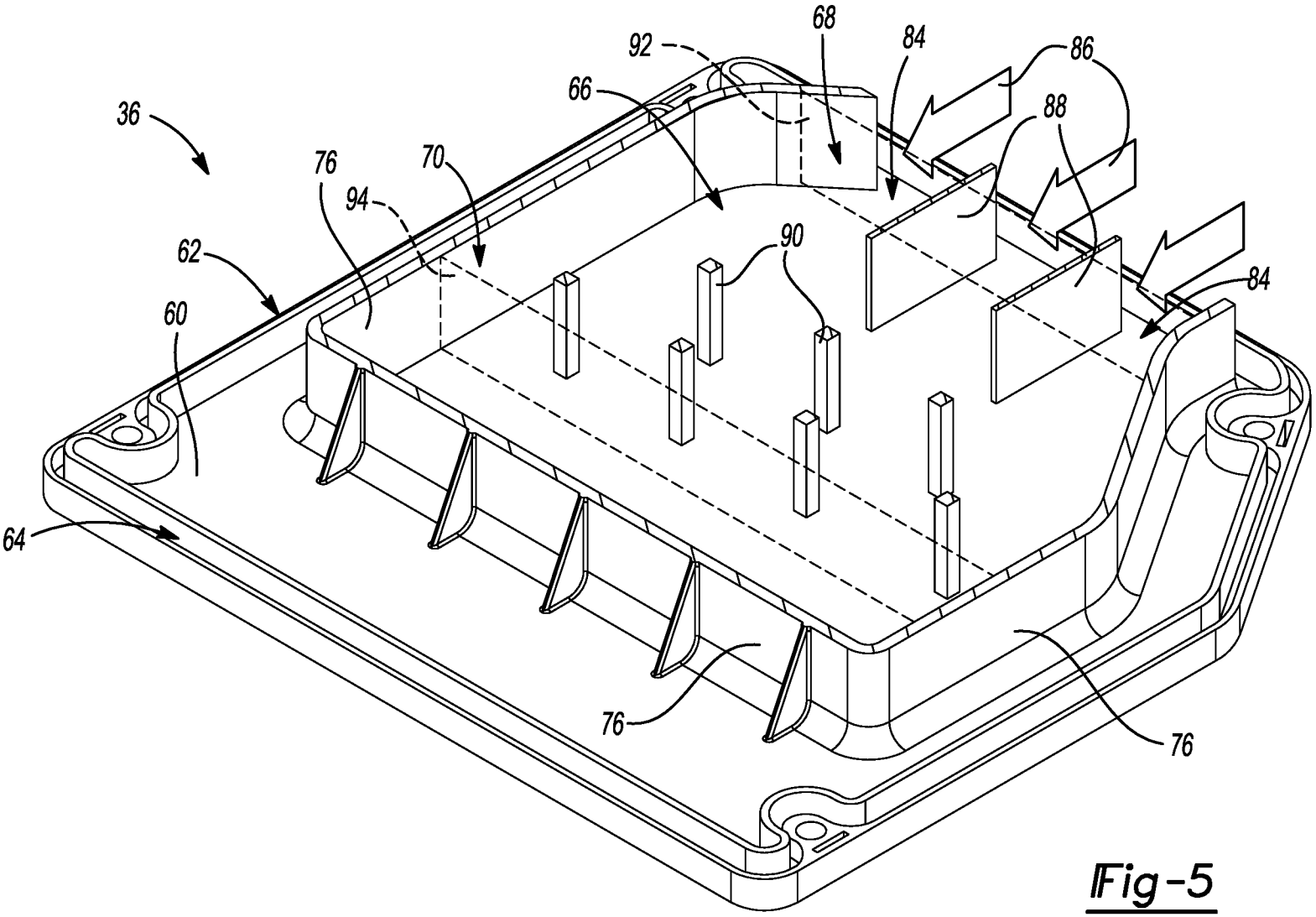
FIG. 5 is a bottom section view of the exemplary lid of the dispenser box assembly shown in FIG. 4.
Figure 6:
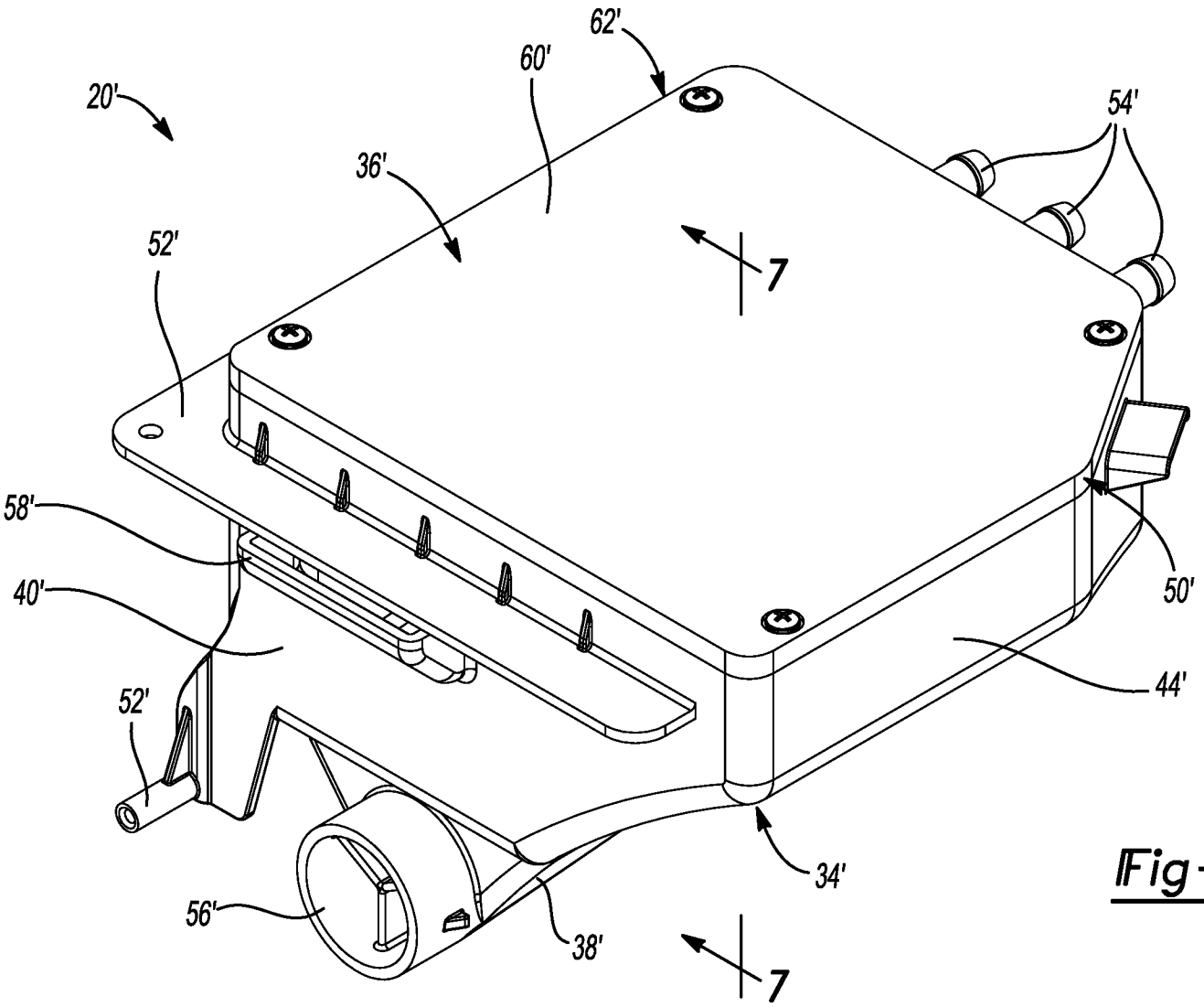
FIG. 6 is a front perspective view of another exemplary dispenser box assembly that has been constructed in accordance with the present disclosure.

With additional reference to FIGS. 4 and 5, the lid 36 of the dispenser box assembly 20 includes an in-lid reservoir 66. The in-lid reservoir 66 has an inlet section 68 that is arranged in fluid communication with the water inlet ports 54 on the dispenser housing 34 and a diffuser section 70 with an outlet 72 that is arranged in fluid communication with the main chamber 48 of the dispenser box assembly 20. In addition to the upper wall 60, the lid 36 includes a lower wall 74 that is spaced below the upper wall 60 and one or more sidewalls 76 that extend down from the upper wall 60 to the lower wall 74 of the lid 36. The lower wall 74 of the lid 36 includes a ramped area 78 in the inlet section 68 that terminates at a leading edge 80. The leading edge 80 of the lower wall 74 is positioned adjacent to the water inlet ports 54, but is spaced from the rear housing wall 42 by a clearance gap 82. This clearance gap 82 combined with the ramped area 78 allows water to drain from the inlet section 68 of the in-lid reservoir 66 when no water is entering the dispenser box assembly 20 through the water inlet ports 54.

As best seen in FIGS. 3 and 5, the inlet section 68 of the in-lid reservoir 66 includes three inlet channels 84 for each of the water inlet ports 54. During a wash cycle, the water inlet ports 54 discharge water into the three inlet channels 84 in the inlet section 68 of the in-lid reservoir 66 in a first flow direction 86. In the illustrated example, the first flow direction 86 that is substantially horizontal, meaning that the first flow direction 86 extends in a direction that is aligned with the upper wall 60 of the lid 36, plus or minus ten degrees.

The inlet channels 84 are defined by two fins 88 that extend from the upper wall 60 of the lid 36 to the lower wall 74 of the lid 36 and are substantially parallel to the first flow direction 86 (i.e., plus or minus ten degrees). The diffuser section 70 of the in-lid reservoir 66 includes a plurality of diffuser posts 90 that extend from the upper wall 60 of the lid 36 to the lower wall 74 of the lid 36. These diffuser posts 90 are positioned in a staggered arrangement inside the diffuser section 70 of the in-lid reservoir 66. In addition to these features, the inlet section 68 of the in-lid reservoir 66 includes a first cross-sectional area 92 that is perpendicular to the first flow direction 86 and the diffuser section 70 of the in-lid reservoir 66 includes a second cross-sectional area 94 that is also perpendicular to the first flow direction 86. The second cross-sectional area 94 of the diffuser section 70 of the in-lid reservoir 66 is larger than the first cross-sectional area 92 of the inlet section 68. Taken together, these features slow down and organize the flow of water exiting the water inlet ports 54 and produce an associated drop in water pressure.

As best seen in FIGS. 3 and 4, the outlet 72 of the in-lid reservoir 66 in this illustrated example is a plurality of apertures 96 that extend through the lower wall 74 of the lid 36. During a wash cycle, water in the diffuser section 70 exits the in-lid reservoir 66, exits through the plurality of apertures 96 in the lower wall 74 of the lid 36 in a second flow direction 98, and falls into the main chamber 48 under the influence of gravity as a shower of fluid. The second flow direction 98 is substantially vertical, meaning that the second flow direction 98 extends in a direction that is perpendicular to the upper wall 60 of the lid 36, plus or minus ten degrees (i.e., the second flow direction 98 is arranged at an 80 to 100 degree angle relative to the upper wall 60 of the lid 36). Because the air port 58 that is open to the atmosphere and arranged in fluid communication with the main chamber 48, the main chamber 48 is open to atmospheric pressure and therefore creates/produces an additional water pressure drop between the water inlet ports 54 and the water outlet port 56. By way of example and without limitation, the water pressure at the water inlet ports 54 may have a nominal pressure of about 80 pounds per square inch (PSI). The water in the main chamber 48 is not under any external/supply dependent pressure and simply drains through the water outlet port 56 under the influence of atmospheric pressure and gravity since the main chamber 48 is open to the atmosphere via the air port 58. As a result, the water pressure at the water outlet port 56 of the dispenser box assembly 20 is simply the head pressure caused by the height 100 of the water in the main chamber 48 and is therefore considerably less than the water pressure at the water inlet ports 54.

Figure 7:
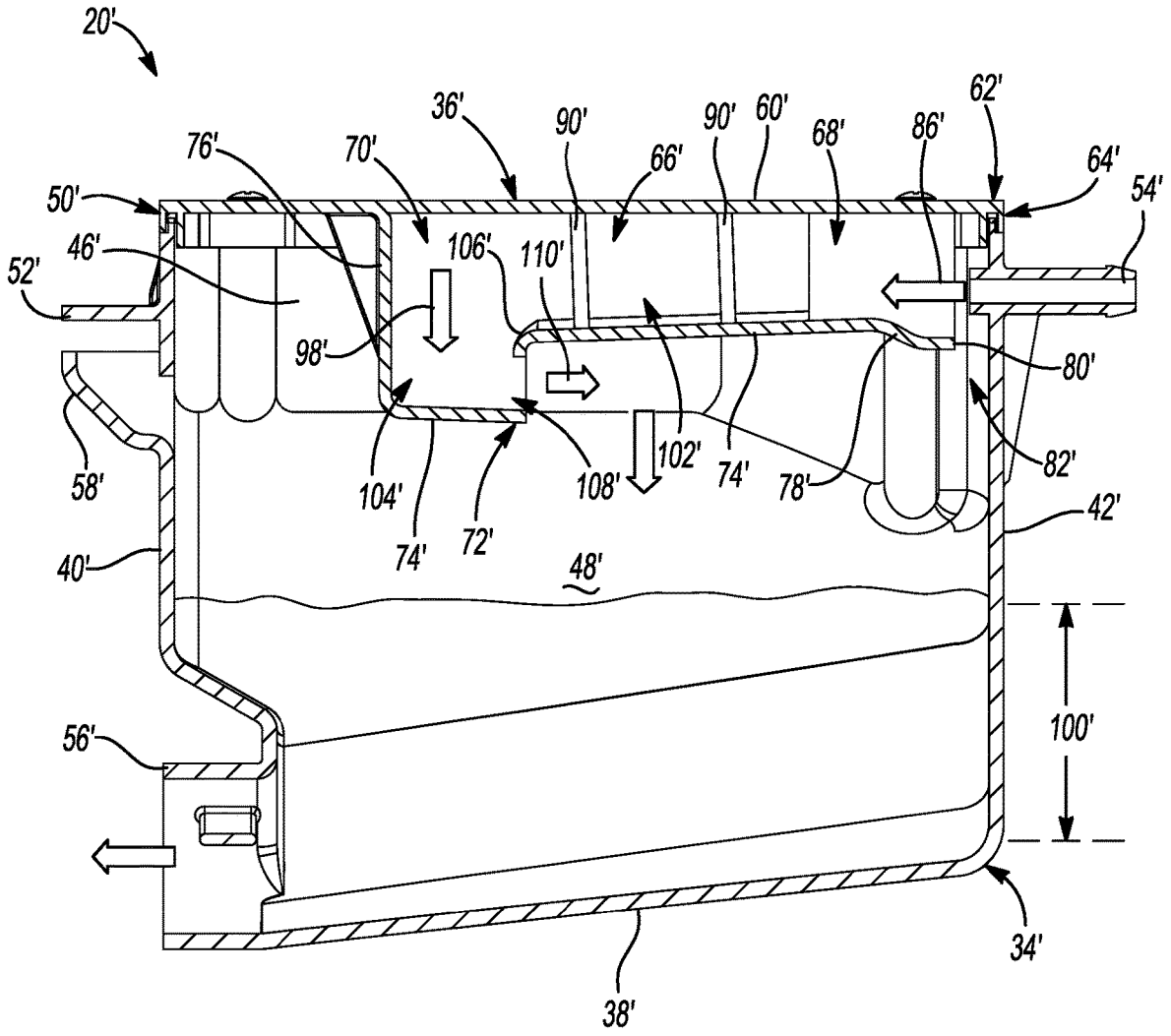
FIG. 7 is a side cross-sectional view of the exemplary dispenser box assembly shown in FIG. 6.
Figure 8:
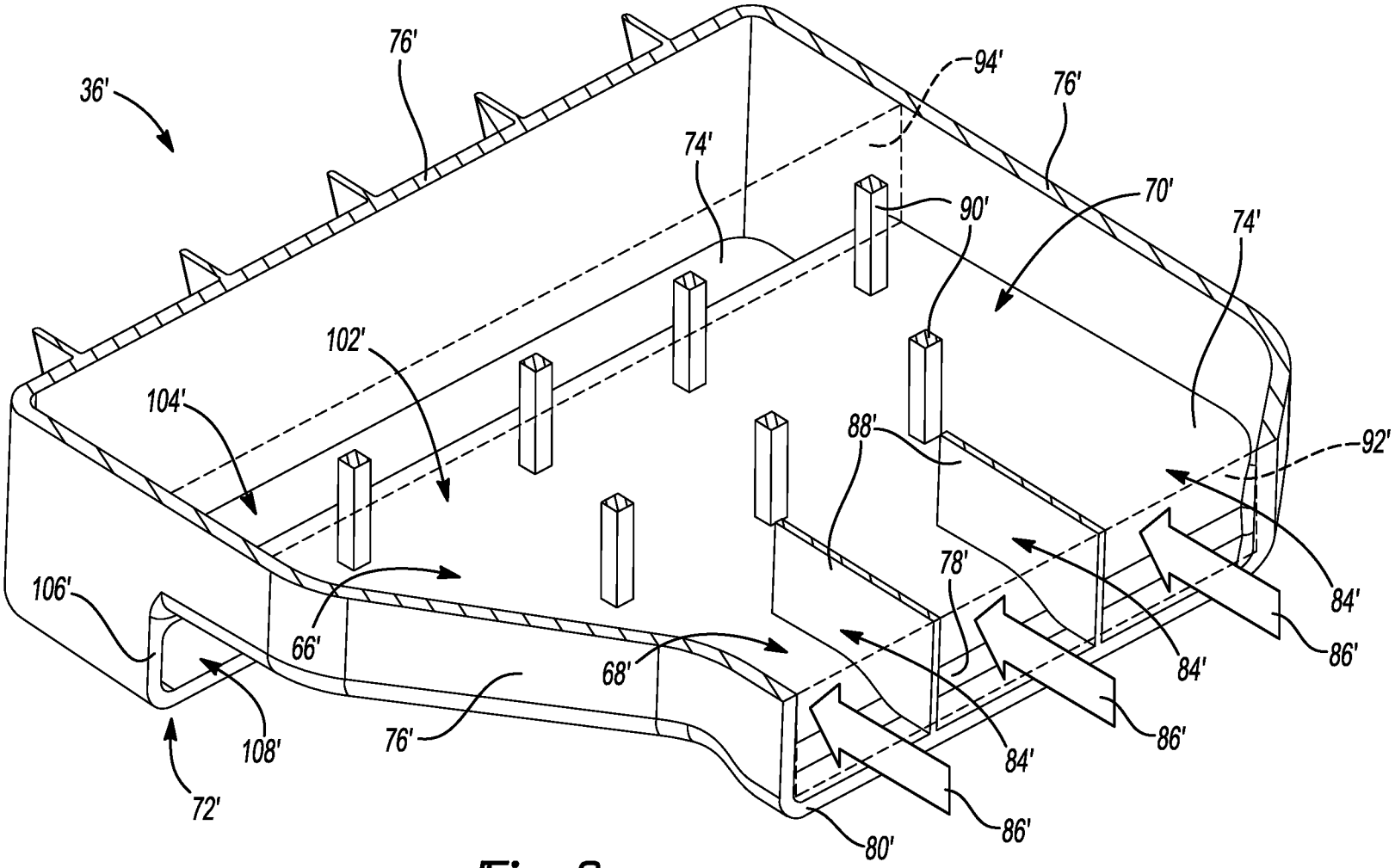
FIG. 8 is a bottom section view of an exemplary lid of the dispenser box assembly shown in FIG. 7.

FIGS. 7 and 8 illustrate another exemplary dispenser box assembly 20', which has a lid 36' and an in-lid reservoir 66' that are constructed in accordance with an alternative configuration. Many of the elements of the dispenser box assembly 20' shown in FIGS. 7 and 8 are the same or similar to the elements of the dispenser box assembly 20 shown in FIGS. 1-6, including the dispenser housing 34, and therefore share the same reference numbers, but have been annotated with a prime symbol (') after the reference numerals.

The in-lid reservoir 66' in this embodiment also has an inlet section 68' that is arranged in fluid communication with the water inlet ports 54' on the dispenser housing 34' and a diffuser section 70' with an outlet 72' that is arranged in fluid communication with the main chamber 48' of the dispenser box assembly 20'. The lid 36' includes an upper wall 60', a lower wall 74' that is spaced below the upper wall 60', and one or more sidewalls 76' that extend down from the upper wall 60' to the lower wall 74' of the lid 36'. The lower wall 74' of the lid 36' includes a ramped area 78' in the inlet section 68' that terminates at a leading edge 80'. The leading edge 80' of the lower wall 74' is positioned adjacent to the water inlet ports 54', but is spaced from the rear housing wall 42' by a clearance gap 82'. This clearance gap 82' combined with the ramped area 78' allows water to drain from the inlet section 68' of the in-lid reservoir 66' when no water is entering the dispenser box assembly 20' through the water inlet ports 54'.

Again, the inlet section 68' of the in-lid reservoir 66' includes three inlet channels 84' for each of the water inlet ports 54'. During a wash cycle, the water inlet ports 54' discharge water into the three inlet channels 84' in the inlet section 68' of the in-lid reservoir 66' in a first flow direction 86', which is substantially horizontal. The inlet channels 84' are defined by two fins 88' that extend from the upper wall 60' of the lid 36' to the lower wall 74' of the lid 36' and are substantially parallel to the first flow direction 86' (i.e., plus or minus ten degrees). The diffuser section 70' of the in-lid reservoir 66' includes a plurality of diffuser posts 90' that extend from the upper wall 60' of the lid 36' to the lower wall 74' of the lid 36'. These diffuser posts 90' are positioned in a staggered arrangement inside the diffuser section 70' of the in-lid reservoir 66'. In addition to these features, the inlet section 68' of the in-lid reservoir 66' includes a first cross-sectional area 92' that is perpendicular to the first flow direction 86' and the diffuser section 70' of the in-lid reservoir 66' includes a second cross-sectional area 94' that is also perpendicular to the first flow direction 86'. The second cross-sectional area 94' of the diffuser section 70' of the in-lid reservoir 66' is larger than the first cross-sectional area 92' of the inlet section 68'. Taken together, these features slow down and organize the flow of water exiting the water inlet ports 54' and produce an associated drop in water pressure.

In this embodiment, the lower wall 74' of the lid 36' has a stepped profile. In accordance with this arrangement, the diffuser section 70' of the in-lid reservoir 66' includes an upper step 102' and a lower step 104'. The lower step 104' of the diffuser section 70' is deeper than the upper step 102' and separated from the upper step 102' by a riser 106', similar in location to the risers of a staircase. In this example, the outlet 72' of the in-lid reservoir 66' is an opening 108' in the riser 106' between the upper and lower steps 102', 104'. The opening 108' in the riser 106' faces the rear housing wall 42' and it should be appreciated that the riser 106' may or may not be a wall, since the opening 108' may extend across the full width and height of the riser 106' between the upper and lower steps 102', 104'.

During a wash cycle, water flows through the in-lid reservoir 66', reverses direction in the lower step 104' and exits through the opening 108' in in the riser 106' between the upper and lower steps 102', 104' where it falls into the main chamber 48' as a waterfall of fluid. More specifically, the in-lid reservoir 66' is arranged such that water flows into the inlet section 68' of the in-lid reservoir 66' and through the upper step 102' in the first flow direction 86', flows from the upper step 102' to the lower step 104' in the in-lid reservoir 66' in a second flow direction 98', and exits through the opening 108' in the lid 36' in a third flow direction 110'. The first flow direction 86' is substantially horizontal, the second flow direction 98' is substantially vertical, and the first and third flow directions 86', 110' point in substantially opposite directions (i.e., they are arranged 180 degrees apart, plus or minus 10 degrees). Because the air port 58' that is open to the atmosphere and arranged in fluid communication with the main chamber 48', the main chamber 48' is open to atmospheric pressure and therefore creates/produces an additional water pressure drop between the water inlet ports 54' and the water outlet port 56'. As a result, the water pressure at the water outlet port 56' of the dispenser box assembly 20' is simply the head pressure caused by the height 100' of the water in the main chamber 48' and is therefore considerably less than the water pressure at the water inlet ports 54'.

In the illustrated example, the laundry appliance 22' is a washer and dryer combination appliance that performs both a wash cycle and a drying cycle; however, it should be appreciated that the dispenser box assembly 20' described herein may also be used in laundry appliances that only perform a wash cycle (i.e., in washing machines).

Many modifications and variations of the apparatus and assemblies described in the present disclosure are possible in light of the above teachings and may be practiced otherwise than as specifically described while within the scope of the appended claims. These antecedent recitations should be interpreted to cover any combination in which the inventive novelty exercises its utility.

What is claimed is:

1. A dispenser box assembly for a laundry appliance, said dispenser box assembly comprising:

a dispenser housing including a bottom wall and housing walls that cooperate to define a main chamber, said housing walls extending up from said bottom wall to an upper rim of said dispenser housing;

at least one water inlet port positioned adjacent to said upper rim of said dispenser housing;

a water outlet port positioned adjacent to said bottom wall of said dispenser housing that is arranged in fluid communication with said main chamber;

a lid attached to said upper rim of said dispenser housing;

said lid including an in-lid reservoir having an inlet section that is arranged in fluid communication with said at least one water inlet port and a diffuser section with an outlet that is arranged in direct fluid communication with said main chamber; and an air port that is open to the atmosphere and arranged in fluid communication with said main chamber such that said main chamber is open to atmospheric pressure and creates a water pressure drop between said at least one water inlet port and said water outlet port, wherein the dispenser box assembly has a drawer-less configuration and wherein said lid is immovably secured to said dispenser housing and is inaccessible from outside the laundry appliance such that the dispenser box assembly functions as an open to atmosphere pressure relief structure for wash water and does not include user accessible compartments for receiving a dose of detergent, bleach, or fabric softener.

2. The dispenser box assembly as set forth in claim 1, wherein said at least one water inlet and said water outlet port extend through said dispenser housing and wherein said in-lid reservoir is arranged such that fluid flow through said at least one water inlet port discharges into said inlet section of said in-lid reservoir in a first flow direction.

3. The dispenser box assembly as set forth in claim 2, wherein said lid includes an upper wall with a perimeter that mates with said upper rim of said dispenser housing, a lower wall that is spaced below said upper wall, and sidewalls that extend from said upper wall to said lower wall.

4. The dispenser box assembly as set forth in claim 3, wherein said outlet of said in-lid reservoir is a plurality of apertures in said lower wall of said lid such that fluid in said in-lid reservoir exits through said plurality of apertures in said lower wall of said lid in a second flow direction and falls into said main chamber as a shower of fluid.

5. The dispenser box assembly as set forth in claim 3, wherein said diffuser section of said in-lid reservoir includes an upper step and a lower step that is deeper and separated from said upper step by a riser and wherein said outlet of said in-lid reservoir is an opening in said riser between said upper and lower steps such that fluid flow in said in-lid reservoir reverses in said lower step and exits through said opening in a third flow direction and falls into said main chamber as a waterfall of fluid.

6. The dispenser box assembly as set forth in claim 3, wherein said at least one water inlet port extends through a rear housing wall and wherein said lower wall of said lid includes a leading edge that is positioned adjacent to said at least one water inlet port and spaced from said rear housing wall by a clearance gap that allows water to drain from said inlet section of said in-lid reservoir.

7. The dispenser box assembly as set forth in claim 3, wherein said at least one water inlet port includes multiple water inlet ports, said inlet section of said in-lid reservoir includes inlet channels for each of said water inlet ports, and said inlet channels are defined by one or more fins that extend from said upper wall of said lid to said lower wall of said lid and are parallel to said first flow direction.

8. The dispenser box assembly as set forth in claim 7, wherein said diffuser section of said in-lid reservoir includes a plurality of diffuser posts that extend from said upper wall of said lid to said lower wall of said lid and are positioned in a staggered arrangement.

9. The dispenser box assembly as set forth in claim 1, wherein said dispenser housing is configured to be fixedly secured within the laundry appliance.

10. The dispenser box assembly as set forth in claim 9, wherein no part of the dispenser box assembly, including no part of said dispenser housing or said lid, is configured to move out from inside an appliance housing of the laundry appliance.

11. The dispenser box assembly as set forth in claim 1, wherein said at least one water inlet port is configured to be connected in fluid communication with at least one water inlet valve of the laundry appliance and wherein said water outlet port is configured to be connected in fluid communication with a wash unit inlet of the laundry appliance.

12. The dispenser box assembly as set forth in claim 1, wherein said air port is positioned in one of said housing walls.

13. A dispenser box assembly for a laundry appliance, said dispenser box assembly comprising:

a dispenser housing defining a main chamber of said dispenser box assembly and having a drawer-less configuration;

said dispenser housing including at least one water inlet port and a water outlet port, said water outlet port arranged in fluid communication with said main chamber;

a lid attached to said dispenser housing;

said lid including an in-lid reservoir having an inlet section that is arranged in fluid communication with said at least one water inlet port and a diffuser section with an outlet that is arranged in fluid communication with said main chamber; and said lid including an upper wall, a lower wall that is spaced below said upper wall, and sidewalls that extend from said upper wall to said lower wall, wherein said outlet of said in-lid reservoir is a plurality of apertures in said lower wall of said lid such that fluid in said in-lid reservoir exits through said plurality of apertures in said lower wall of said lid and falls directly into said main chamber as a shower of fluid, wherein the dispenser assembly does not include user accessible compartments for receiving a dose of detergent, bleach, or fabric softener.

14. The dispenser box assembly as set forth in claim 13, wherein said in-lid reservoir is arranged such that fluid flow through said at least one water inlet port discharges into said inlet section of said in-lid reservoir in a first flow direction and exits through said plurality of apertures in said lower wall of said lid in a second flow direction.

15. The dispenser box assembly as set forth in claim 14, wherein said first flow direction is substantially horizontal and said second flow direction is substantially vertical.

16. The dispenser box assembly as set forth in claim 13, wherein no part of the dispense box assembly, including no part of said dispenser housing or said lid, is configured to move out from an appliance housing of the laundry appliance.

17. A dispenser box assembly for a laundry appliance, said dispenser box assembly comprising:

a dispenser housing defining a main chamber of said dispenser box assembly and having a drawer-less configuration;

said dispenser housing including at least one water inlet port and a water outlet port, said water outlet port arranged in fluid communication with said main chamber;

a lid attached to said dispenser housing;

said lid including an in-lid reservoir having an inlet section that is arranged in fluid communication with said at least one water inlet port and a diffuser section with an outlet that is arranged in fluid communication with said main chamber;

said lid including an upper wall, a lower wall that is spaced below said upper wall, and sidewalls that extend from said upper wall to said lower wall; and said diffuser section of said in-lid reservoir includes an upper step and a lower step that is deeper and separated from said upper step by a riser, wherein said outlet of said in-lid reservoir is an opening in said riser between said upper and lower steps such that fluid flow in said in-lid reservoir reverses in said lower step and exits through said opening and falls into said main chamber as a waterfall of fluid.

18. The dispenser box assembly as set forth in claim 17, wherein said in-lid reservoir is arranged such that fluid flow through said at least one water inlet port discharges into said inlet section of said in-lid reservoir in a first flow direction, flows from said upper step to said lower step in said in-lid reservoir in a second flow direction, and exits through said opening in said lid in a third flow direction.

19. The dispenser box assembly as set forth in claim 18, wherein said first flow direction is substantially horizontal, wherein said second flow direction is substantially vertical, and wherein said first and third flow directions point in substantially opposite directions.

* * * * *